United States Patent [19]

Senoh

[11] Patent Number: 4,539,444

[45] Date of Patent: Sep. 3, 1985

[54] SIMPLIFIED ELECTRIC SWITCH CONSTRUCTION

[75] Inventor: Yasutaka Senoh, Yokohama, Japan

[73] Assignee: New Ohto Co., Ltd., Yokohama, Japan

[21] Appl. No.: 567,778

[22] Filed: Jan. 3, 1984

[30] Foreign Application Priority Data

May 25, 1983 [JP] Japan ..... 58-92094

[51] Int. Cl.[3] ..... H01H 1/18

[52] U.S. Cl. ..... 200/5 R; 200/6 BB; 200/242; 200/292

[58] Field of Search ..... 200/5 R, 242, 279, 153 L, 200/DIG. 29, 6 R, 6 B, 292, 6 BA, 6 BB

[56] References Cited

U.S. PATENT DOCUMENTS

| | | | |
|---|---|---|---|
| 2,967,215 | 1/1961 | Whiting | 200/153 L X |
| 3,165,732 | 1/1965 | Klosterman | 200/153 L |
| 3,562,464 | 10/1968 | Vollum et al. | 200/292 X |
| 4,081,632 | 3/1978 | Schaffeler | 200/5 R X |

FOREIGN PATENT DOCUMENTS

| | | | |
|---|---|---|---|
| 218191 | 7/1924 | United Kingdom | 200/242 |

*Primary Examiner*—A. D. Pellinen
*Assistant Examiner*—Morris Ginsburg
*Attorney, Agent, or Firm*—Pahl, Lorusso & Loud

[57] ABSTRACT

A simplified electric switch construction is disclosed. The switch construction comprises at least a pair of confronting first and second terminals each having a bridge portion, a conductive resilient plate having one end shaped as a polygonal pyramid disposed in confronting relation to the bridge portion of the first terminal and an opposite end connected to the bridge portion of the second terminal, a presser for depressing an intermediate portion of the resilient plate to bring the tapered end into contact with the bridge portion of the first terminal, and a driver for depressing the presser. The switch construction may contain a printed-circuit board with an electric circuit thereon.

4 Claims, 19 Drawing Figures

SIMPLIFIED ELECTRIC SWITCH CONSTRUCTION

BACKGROUND OF THE INVENTION

The present invention relates to a simplified electric switch construction including movable conductive contact members having a high contact pressure for making electric connection between terminals, and more particularly to such a switch construction which is simple in structure, stable in ON-OFF operation, small in size, and contains an electronic circuit.

Various mechanisms have been devised for electric connection between terminals in switches. The known mechanisms have suffered from the problem of poor contact between contacts of movable conductive contact members and contacts of terminals (hereinafter referred to as "bridge portions"). FIG. 1 of the accompanying drawings shows a conventional switch in which a terminal 1*a* has a bridge portion 2*a* to which a contact member 3 is fixed. A contact of the contact member 3 is brought into contact with a bridge portion 2*b* of a terminal 1*b* by depressing one end 4 of the contact member 3. Since the contact 5 is pressed merely by a push against the bridge portion 2*b* through an area of contact, any dust or flux therebetween cannot be effectively removed. Any oxidized coating formed on the contact surfaces with time cannot be coped with, and it is necessary to plate the contact surfaces with precious metal which is chemically stable. According to another prior switch illustrated in FIG. 2, a contact member 7 normally urged downwardly by a spring 6 is moved to the right (as shown) to bring a contact 8*b* of the contact member 7 into contact with a bridge portion 10*b* of a terminal 9*b* while keeping a contact 8*a* of the contact member 7 in contact with a bridge portion 10*a* of a terminal 9*a*. This arrangement is better than the depression-type switch construction since the contact 8*b* is held in frictional contact with the bridge portion 10*b*. However, there is a structural limitation against imposing a sufficient contact pressure to remove any unwanted deposit sufficiently from the contact surfaces.

There is known a DIP (dual in-line package) switch construction having an electronic circuit responsive to operation of a switch drive unit for selecting desired terminals to achieve a certain electric fuction. The DIP switch construction is composed of ordinary DIP switch terminals connected to portions of an electronic circuit on a printed-circuit board and accommodated in a casing. Its fabrication requires separate preparation of a DIP switch and a printed-circuit board having an electronic circuit provided thereon and normally molded in a mass of resin. Therefore, the conventional DIP switch construction is likely to be increased in size. It would be possible to form the DIP switch and the printed-circuit board as an integral structure. However, prior individual switches used as DIP switches would have a structural limitation against miniaturization, and would suffer from less contact stability due to a small current to pass through the switch. No good contact would be obtained if the conventional switch contact members were pressed against contacts printed on the printed-circuit board. To avoid this shortcoming, the contacts on the printed-circuit board and contact members would have to be plated with gold, and would be provided with greater surfaces of contact.

SUMMARY OF THE INVENTION

The above-described drawbacks in the prior art apparatus have been successively eliminated by the present invention.

It is an object of the present invention to provide a simplified electric switch construction including movable conductive contact members having a high contact pressure for making electric connection between terminals.

Another object of the present invention is to provide a switch construction which is simple in structure, stable in ON-OFF operation, small in size, and contains an electronic circuit.

To achieve the above objects, a simplified electric switch construction according to the present invention comprises at least a pair of confronting first and second terminals each having a bridge portion, a conductive resilient plate having one end shaped as a polygonal pyramid in confronting relation to the bridge portion of the first terminal and an opposite end connected to the bridge portion of the second terminal, a presser for depressing an intermediate portion of the resilient plate to bring the tapered end into contact with the bridge portion of the first terminal, and a driver for depressing the presser. The switch construction may contain a printed-circuit board with an electric circuit thereon, the construction being small in size.

These and other objects of the invention will become apparent from the following description of embodiments thereof when taken together with the drawings.

DETAILED DESCRIPTION OF THE PREFERRED EMBODIMENTS

Figure 1:
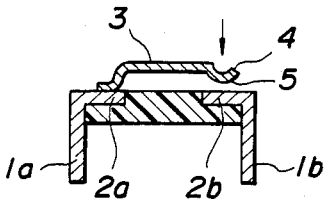
FIG. 1 PRIOR ART
FIGS. 1 and 2 are cross-sectional views of conventional switches.
Figure 2:
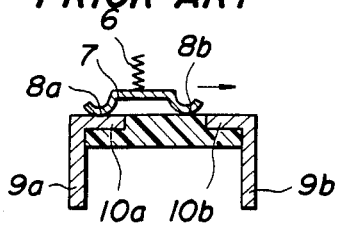
FIG. 2 PRIOR ART
Figure 4:
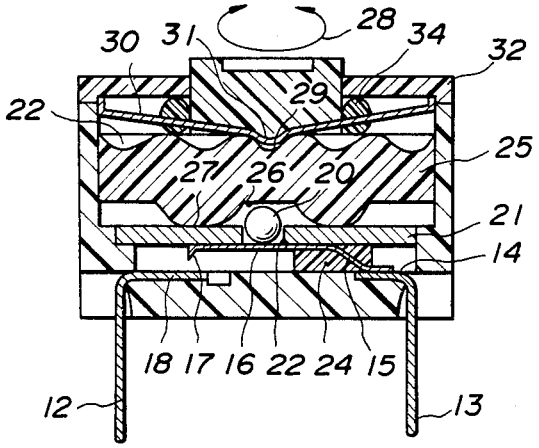
FIG. 4 is a cross-sectional view of the rotary switch shown in FIG. 3.

A rotary switch according to an embodiment of the present invention for binary settings for an electronic circuit will be described with reference to FIGS. 3 and 4.

Figure 3:
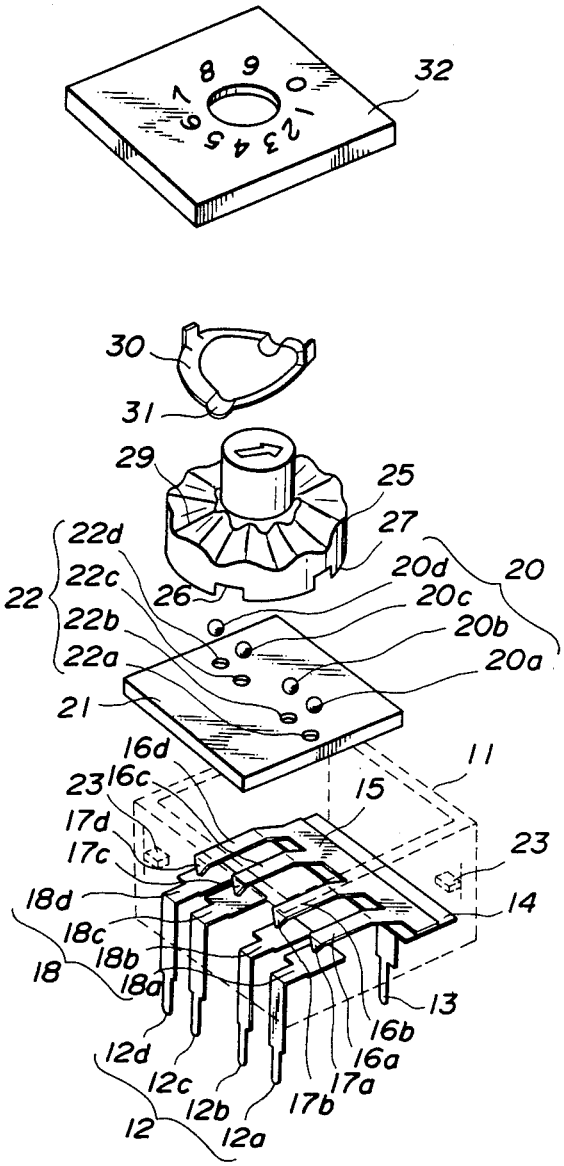
FIG. 3 is an exploded perspective view of a rotary switch according to an embodiment of the present invention.
Figure 11:
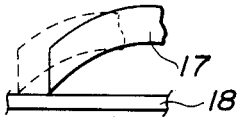
Figure 13A:
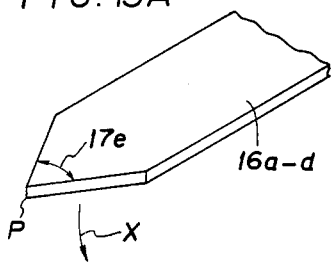
FIGS. 13(*a*) and 13(*b*) are perspective views showing a process of manufacturing a movable contact member in the switch shown in FIGS. 3 and 4.
Figure 13B:
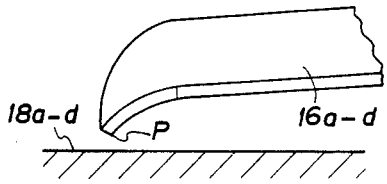

The rotary switch comprises a casing 11 shown by the dotted lines in FIG. 3 supporting four output terminals 12*a* through 12*d* and a single common input terminal 3 which are attached in place by insert molding. The input terminal 13 has a bridge portion 14 to which there is affixed as by fusing a contact body 15 in the form of a conductive, resilient metal plate. The contact body 15 has four movable contact members 16*a* through 16*d* extending from the portion thereof fixed to the bridge portion 14. The contact members 16*a* through 16*d* are bent at their proximal ends and urged upwardly, and have distal ends 17*a* through 7*d* punched out thicknesswise to form an acute angle 17*e* (FIG. 13(*a*)) and bent in the direction of the arrow X to direct a vertex P (FIG. 13(*b*)) shaped as a triangular pyramid (polygonal pyramid) in confronting relation to bridge portions 18*a* through 18*b*, respectively, of the terminals 12*a* through 12*d*. When intermediate portions of the contact members 16*a* through 16*d* are depressed, the vertexes P shaped as triangular pyramids and acting as cutter blade edges of the contact ends 17*a* through 17*d* are brought into point-to-point contact with the bridge portions 18*a* through 18*d* to impose a high pressure contact on the order of 100 kg/mm$^2$ on the bridge portions 18*a* through 18*b*, respectively. At the same time, as shown in FIG. 11, each contact end formed as the cutter blade edge scratches the corresponding bridge portion from the solid-line position to the dotted-line position as the tapered contact end is depressed. Therefore, any flux, dust or dirt, and oxidized layer on the bridge portions 18*a* through 18*d* is removed or broken to thereby activate the contact surfaces. While in the illustrated embodiment the contact members 16*a* through 16*d* are connected to the common contact terminal 13 via the contact body 15, the contact body 15 may be dispensed with, and the contact members 16*a* through 16*d* may be fixed respectively to four independent input terminal bridge portions (not shown), so that four independent input-output circuits may be provided.

Figure 10:
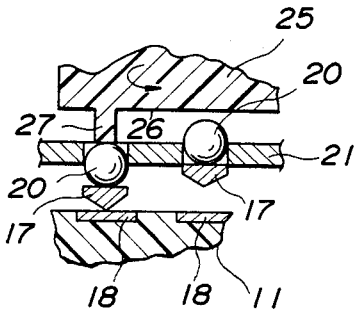
FIGS. 10 and 11 are fragmentary views illustrative of operation of the switch shown in FIGS. 3 and 4.

The rotary switch also includes four pressers or steel balls 20*a* through 20*d* held respectively in holes 22*a* through 22*d* in a holder plate 21 disposed above the contact members 16*a* through 16*d*, the steel balls 20*a* through 20*d* serving to depress the vertexes P of the contact members 16*a* through 16*d*, respectively. The holder plate 21 is supported in the casing 11 by a pair of ledges 23 mounted on an inner wall surface of the casing 11 at dismetrically opposite corners thereof and also by a seat 24 (FIG. 4) disposed between the contact members 16*b*, 16*c* on the bottom of the casing 11. The holder plate 21 is fixed in place by being pressed down to resiliently hold down the contact members 16*a* through 16*d* which are urged upwardly for thereby positioning the contact ends 17*a* through 17*d* in upwardly spaced relation to the bridge portions 18*a* through 18*d* respectively. The holes 22*a* through 22*d* in the holder plate 21 are positioned over intermediate portions of the contact members 16*a* through 16*d*, respectively, and have a diameter larger than that of the steel balls 20*a* through 20*d*. Therefore, the steel balls 20*a* through 20*d* can move vertically in the holes 22*a* through 22*d*, respectively. The steel balls 20*a* through 20*d* are raised by the contact members 16*a* through 16*d* normally held against the lower surface of the holder plate 21 so that the steel balls 20*a* through 20*d* have portions exposed above the upper surface of the holder plate 21. When the steel balls 20*a* through 20*d* are depressed, they lower the contact members 16*a* through 16*d*, respectively, to cause the tapered contact ends 17*a* through 17*d* into abutting contact with the bridge portions 18*a* through 18*d* and then force the contact members 16*a* through 16*d* to flex downwardly to enable the tapered contact ends 17*a* through 17*d* to scratch the bridge portions 18*a* through 18*d*, as illustrated in FIGS. 10 and 11. Since the tapered contact ends 17*a* through 17*d* not only contact the bridge portions 18*a* through 18*d* but also scratch theem under a high contact pressure, any unwanted foreign matter such as dirt, dust, flux, and oxidized coating can easily be removed from the bridge portions 18*a* through 18*d* which are then activated for reliable and stable electric contact with the contact members 16*a* through 16*d*.

While the contact members 16*a* through 16*d* are shown as being depressed by the steel balls 20*a* through 20*d*, the contact members 16*a* through 16*d* may be pressed downwardly by any other suitable bodies such as cylindrical bodies or rods with rounded heads provided they can be smoothly engaged by a driver (described later on) and depress the contact members 16*a* through 16*d* until they flex downwardly. With such an alternative, the contact members 16*a* through 6*d* may have be of a substantially circular shape with a smooth projection.

Figure 12:
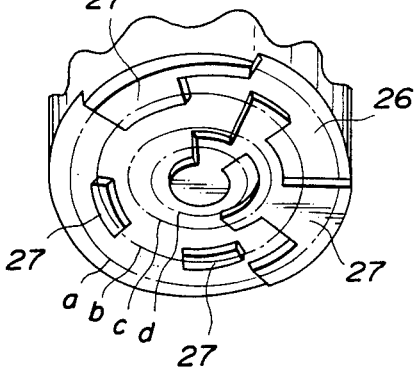
FIG. 12 is a fragmentary perspective view of the switch shown in FIGS. 3 and 4.

The steel balls 20*a* through 20*d* can selectively be depressed by a rotatable driver 25 (FIG. 3) having on its back cam lands 27 (FIG. 12) projecting from a surface 26 in positions of segments separated radially and circumferentially along four circular paths a through d according to numerical weighting of $2^0$–$2^3$. Since any steel ball 20 positioned below the surface 26 is not depressed (FIG. 4), the corresponding contact member 16 disposed therebelow is not in contact with the output terminal bridge portion 18, and hence no electric output is produced from the output terminal 12. Any steel ball 20 positioned below one of the cam lands 27 is depressed, and hence the contact member 16 below the depressed steel ball 20 is caused to contact the corresponding bridge portion 18 which is then electrically connected to the input terminal 13 to issue an electric output. By rotating the driver 25 clockwise or counterclockwise in the direction of the arrow 28 (FIG. 4), the signal from the input terminal 13 is delivered selectively to the terminals 12*a* through 12*d* according to the angular displacement of the driver 25 (angularly oriented to one of numbers "0" through "9" inscribed on a cover 32 (FIG. 3). A numerical value can then be produced in 4-bit parallel binary notation from the output terminals 12*a* through 12*d* dependent on the contact combination.

An O-ring 34 (FIG. 4) is mounted on a shoulder around a central shank of the driver 25. An indexing ring 30 has a pair of diametrically opposite ridges 31 placed in slots 29 in a corrugated surface of the driver 25. The cover 32 is placed over the casing 11 and fused thereto. The switch construction as thus assembled is shown in FIG. 4.

Figure 5A:
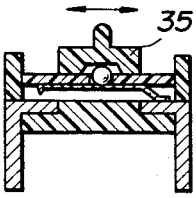
FIGS. 5*a*, 5*b*, and 5*c* are cross-sectional views of switches according to other embodiments of the present invention.
Figure 5B:
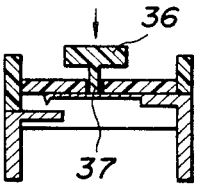
Figure 5C:
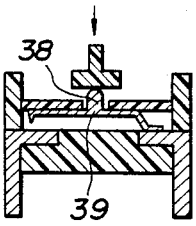

While the rotary switch for binary settings have been shown and described, the present invention is in no way limited to such a switch construction. For example, the invention is applicable to a sliding switch having a slidable driver 35 as shown in FIG. 5*a*, a pushbutton switch having a pushbutton 36 with a pusher rod 37 as shown in FIG. 5*b*, or a pushbutton switch including a contact member 39 having a presser projection 38 as shown in FIG. 5*c*.

With the switch of the foregoing embodiment, as described above, the movable contact members comprise conductive resilient plates having ends punched to form acute angles and bent into vertexes shaped as polygonal pyramids disposed in confronting relation to terminal bridge portions and opposite ends fixed to other terminal bridge portions. When intermediate portions of the contact members are depressed, the latter are moved down the cause the tapered contact ends thereof to contact the bridge portions under a high contact pressure and at the same time are caused to flex to enable the tapered contact ends to scratch the bridge portions, so that any flux, dirt, dust, and oxidized coating on the bridge portions can be removed or broken for activating the contact surfaces of the bridge portions. As a result, the switch construction of the invention is capable of stable and reliable switching operation, and can be used for passing or cutting off a small current. With this arrangement, there is no need for plating the contact surfaces with gold or silver, and the switch construction is simple in structure and hence quite inexpensive to manufacture.

Figure 6:
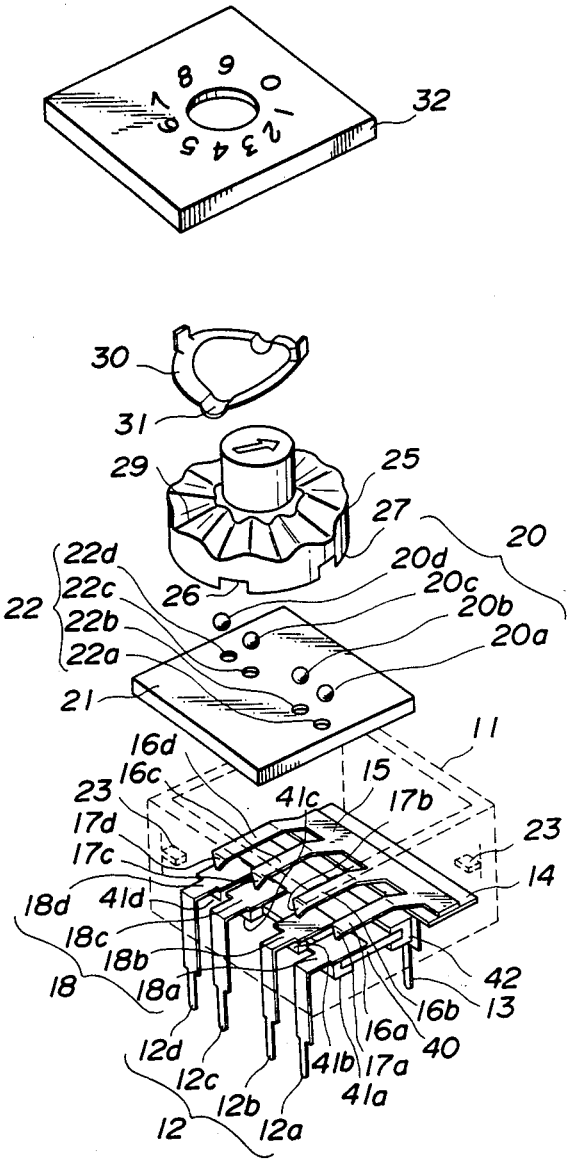
FIG. 6 is an exploded perspective view of a rotary switch according to a still other embodiment of the present invention.
Figure 7:
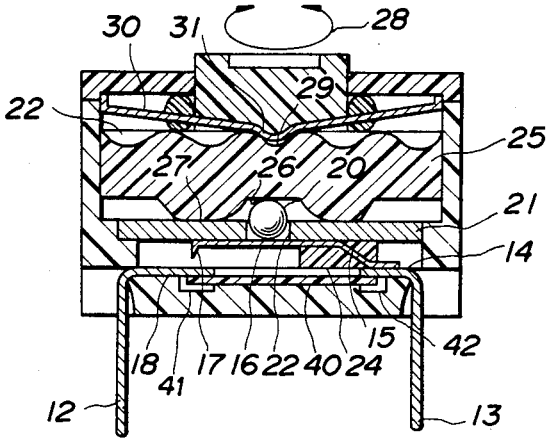
FIG. 7 is a cross-sectional view of the rotary switch shown in FIG. 6.

FIGS. 6 and 7 show a switch construction according to another embodiment in which an electronic circuit is incorporated therein. Like or identical parts in FIGS. 6 and 7 are denoted by like or identical reference characters in FIGS. 3 through 5, and will not be described in detail.

As illustrated in FIGS. 6 and 7, output terminals 12*a* through 12*d* and a common input terminal 13 have vertically separated bridge portions 18*a* through 18*d* and 41*a* through 41*d*, and 14 and 42. These upper and lower bridge portions vertically sandwich a printed-circuit board 40 with an electronic circuit disposed on a lower surface thereof. The output terminals 12*a* through 12*d* and the common input terminal 13 are connected through the lower bridge portions 41*a* through 41*d* and 42 respectively to electronic-circuit portions of the printed-circuit board 40. The connected bridge portions and the printed-circuited board are molded integrally and housed in a casing 11. By thus integrally molding and placing the assembly in the casing 11, the switch construction can be greatly reduced in size. The upper bridge portions 18*a* through 18*d* and 14 are placed on an upper surface of the printed-circuit board 40. Although not shown, the printed-circuit board 40 itself has a number of terminals with joined lead wires extending outwardly of the casing 11.

Figure 8A:
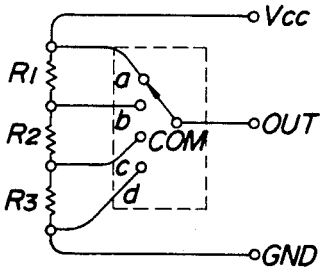
FIGS. 8*a* and 8*b* are circuit diagrams of a potentiometer and a chip selector which constitute electronic circuits on a printed-circuit board.
Figure 8B:
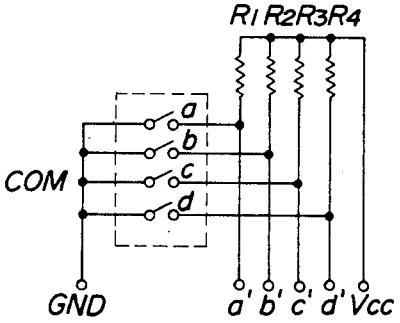

The electronic circuit on the printed-circuit board 40 may comprise a potentiometer as shown in FIG. 8*a* or a chip selector as shown in FIG. 8*b*. The potentiometer of FIG. 8*a* includes a common terminal COM which can be connected selectively to terminals a through d by bringing one of the contact members 16*a* through 16*d* into contact with a corresponding one of the bridge portions 18*a* through 18*d* of the output terminals 12*a* through 12*d*. When the common terminal COM is thus connected to one of the terminals a through d, an applied voltage Vcc as divided a resistor R1, R2, or R3 is obtained from an output terminal OUT. The chip selector illustrated in FIG. 8*b* has a common terminal COM which can be connected selectively to terminals a through d in the same manner as that of the potentiometer of FIG. 8*a*. When the common terminal COM is coupled to one of the terminals a through d, one of output terminals a′ through d′ which corresponds to the one of the terminals a through d that has been connected to the common terminal COM is changed from the potential of a divided voltage Vcc applied to the ground potential. The chip selector can however meet a requirement to provide an output in a binary code. More specifically, the terminals a through d may be numerically weighted with $2^0$–$2^3$, and a plurality of terminals may be switched in synchronism to obtain parallel binary codes from the output terminals a′ through d′.

Although in the arrangements of FIGS. 8*a* and 8*b* the components employed in the potentiometer and the chip selector are all resistors, capacitors, diodes, or logic elements may be used in place of the resistors.

The casing 11 and the cover 32 may be molded of a thermosetting resin. However, the manufacturing control is awkward since the temperature at which the resin is set is high (280° C. for example) and it takes a long time for the resin to set. Where the parts are molded of a thermoplastic resin, the manufacturing control is easy and the cost is low because the molding temperature is relatively low (170° through 260° C. for example) and the molding process takes a short period of time. While the casing 11 and the cover 32 of thermoplastic resin are thermally deformable and softenable, they are reinforced by the printed-circuit board 40 which is made of ceramics, glass, or epoxy resin for increased mechanism or physical dimensional stability and strength. Where the casing 11 and the cover 32 shown in FIGS. 3 through 5 are made of a thermoplastic resin, a reinforcing board (with no electronic circuit) may be placed in the position of the printed-circuit board shown in FIGS. 6 and 7 to strengthen the components for increased mechanical or physical dimensional stability and strength against thermal deformation.

Figure 9A:
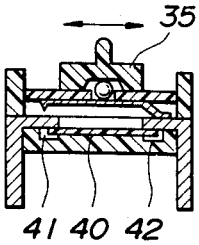
FIGS. 9*a*, 9*b*, 9*c* are cross-sectional views of switches of other embodiments.
Figure 9B:
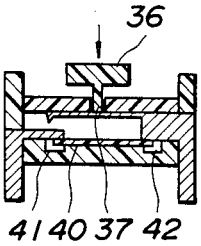
Figure 9C:
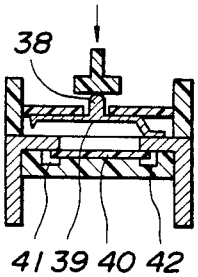

While the rotary switch for binary settings have been shown and described with respect to FIGS. 6 and 7, the present invention is in no way limited to such a switch construction. For example, the invention is applicable to a sliding switch having a slidable driver 35 as shown in FIG. 9*a*, a pushbutton switch having a pushbutton 36 with a pusher rod 37 as shown in FIG. 9*b*, or a pushbutton switch including a contact member 39 having a presser projection 38 as shown in FIG. 9*c*. In each of these alternatives, the printed-circuit board 40 is disposed in the switch casing.

With the switch construction having an electronic circuit contained therein, as described above, a printed-circuit board with an electronic circuit thereon and a separate DIP switch are not employed, but a DIP switch and a printed-circuit board with an electronic circuit thereon are intergrally put together with the printed-circuit board sandwiched between upper and lower terminal bridge portions and disposed in the casing. Therefore, the switch construction is quite small in size. In addition, the movable contact members comprise conductive resilient plates having ends punched to form acute angles and bent into vertexes shaped as triangular pyramids disposed in confronting relation to terminal bridge portions and opposite ends fixed to other terminal bridge portions. When intermediate portions of the contact members are depressed, the latter are moved down the cause the tapered contact ends thereof to contact the bridge portions under a high contact pressure and at the same time are caused to flex to enable the tapered contact ends to scratch the bridge portions, so that any flux, dirt, dust, and oxidized coating on the bridge portions can be removed or broken for activating the contact surfaces of the bridge portions. As a result, the switch construction of the invention is capable of stable and reliable switching operation, and can be used for passing or cutting off a small current.

With this arrangement, there is no need for plating the contact surfaces with gold or silver, and the switch construction is simple in structure and hence quite inexpensive to manufacture.

Thus, there is provided in accordance with the invention a simplified electric switch structure which has the advantage discussed above. The embodiments described are intended to be merely excemplary and those skilled in the art will be able to make variations and modifications in them without departing from the spirit and scope of the inventions. All such modifications and variations are contemplated as falling within the scope of the claims.

What is claimed is:

1. An electric switch construction comprising:

(a) at least a pair of confronting first and second terminals each having a bridge portion;

(b) a conductive resilient plate having one end shaped as a pyramid disposed in confronting relation to the bridge portion of said first terminal and an opposite end connected to the bridge portion of said second terminal;

(c) a presser for depressing an intermediate portion of said resilient plate to bring said pyramid-shaped end into point to point contact with the bridge portion of said first terminal and for causing said pyramid-shaped end to slide across the contacted surface of the bridge portion of said first terminal; and (d) a driver for depressing said presser.

2. An electric switch construction according to claim 1, wherein said presser comprises a steel ball, further including a holder plate holding down said resilient plate and having a hole positioned over said intermediate portion of the resilient plate, said steel ball being placed in said hole and pushed by said resilient plate so as to be partly exposed out of said hole.

3. An electric switch construction comprising:

(a) a printed-circuit board with an electric circuit thereon;

(b) at least a pair of first and second terminals connected to said electric circuit on said printed-circuit board, each of said terminals having a bridge portion;

(c) a conductive resilient plate having one end shaped as a pyramid disposed in confronting relation to the bridge portion of said first terminal and an opposite end connected to the bridge portion of said second terminal;

(d) a presser for depressing an intermediate portion of said resilient plate to bring said pyramid-shaped end into point-to-point cotact with the bridge portion of said first terminal and for causing said pyrmaid-shaped end to slide across the contacted surface of the bridge portion of said first terminal; and (e) a driver for depressing said presser.

4. An electric switch construction according to claim 3, wherein said presser comprises a steel ball, further including a holder plate holding down said resilient plate and having a hole positioned over said intermediate portion of the resilient plate, said steel ball being placed in said hole and pushed by said resilient plate so as to be partly exposed out of said hole.

* * * * *